US007816618B2

(12) United States Patent
Uchii

(10) Patent No.: US 7,816,618 B2
(45) Date of Patent: Oct. 19, 2010

(54) GAS INSULATED SWITCHGEAR

(75) Inventor: Toshiyuki Uchii, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 364 days.

(21) Appl. No.: 11/727,175

(22) Filed: Mar. 23, 2007

(65) Prior Publication Data

US 2007/0221626 A1 Sep. 27, 2007

(30) Foreign Application Priority Data

Mar. 27, 2006 (JP) ..... 2006-084813

(51) Int. Cl.
*H01H 33/04* (2006.01)

(52) U.S. Cl. ..... 218/43; 218/51; 218/59

(58) Field of Classification Search ..... 218/2, 218/3, 7, 13, 14, 43–52, 55, 59, 68–71, 78–80, 218/84, 153, 154
See application file for complete search history.

(56) References Cited

U.S. PATENT DOCUMENTS

| | | | | |
|---|---|---|---|---|
| 4,403,125 | A * | 9/1983 | Yamaoka et al. | 218/147 |
| 4,658,108 | A | 4/1987 | Mauthe | |
| 4,665,289 | A | 5/1987 | Yanabu et al. | |
| 5,761,025 | A * | 6/1998 | Iversen | 361/617 |
| 6,437,273 | B2 * | 8/2002 | Stechbarth et al. | 218/3 |
| 6,621,030 | B2 * | 9/2003 | Andou et al. | 218/43 |

FOREIGN PATENT DOCUMENTS

| | | | |
|---|---|---|---|
| JP | H07-097466 | | 10/1995 |
| JP | H07-109744 | | 11/1995 |
| JP | 2000-164040 | A | 6/2000 |
| JP | 2002-233012 | A | 8/2002 |
| JP | 2003-281980 | A | 10/2003 |
| JP | 2004164994 | A * | 6/2004 |
| WO | WO 2007032344 | A1 * | 3/2007 |

OTHER PUBLICATIONS

Toshiyuki Uchii, Hiromichi Kawano, Tetsuya Nakamoto, Hitoshi Mizoguchi, "Fundamental Properties of $CO_2$ Gas as an Arc Quenching Medium and Thermal Interruption Performance of Full-scale GCB Model" IEEJ Transactions on Power and Energy, 2004, pp. 469-475, vol. 124, 3.
"Environmental Burden of $SF_6$ and Gas Insulation Mixtures / Alternatives to $SF_6$," IEEJ Technical Communications, May 2001, 841.

* cited by examiner

*Primary Examiner*—Renee S Luebke
*Assistant Examiner*—Marina Fishman
(74) *Attorney, Agent, or Firm*—Foley & Lardner LLP

(57) ABSTRACT

The invention secures superior performance by restraining carbon generation also when using as an arc extinguishing medium a gas comprising the element C and having a global warming potential lower than that of $SF_6$ gas. A fixed contact section and a movable contact section are arranged opposite each other inside a sealed container filled with an insulating gas. A fixed arc contact and a movable arc contact are provided in the fixed contact section and the movable contact section. The insulating gas is a mixed gas of a gas comprising the element C, as the main constituent, and other gases. The presence of $O_2$ gas in the mixed gas has the effect of restraining the amount of carbon generated. Adding $H_2$ to the mixed gas has the effect of enhancing arc extinguishing performance, compensating for the diminished performance derived from not using actively the thermal energy of the arc.

13 Claims, 9 Drawing Sheets

PRIOR ART

GAS INSULATED SWITCHGEAR

BACKGROUND OF THE INVENTION

1. Field of the Invention

The present invention relates to a gas insulated switchgear wherein mutually detachable contacts are arranged in a sealed container filled with an insulating gas, and more particularly relates to a gas insulated switchgear having excellent interrupting performance while using an insulating gas having a global warming potential lower than that of $SF_6$ gas.

2. Description of the Related Art

Depending on their intended use and required functionality, a gas insulated switchgear having a current interruption function include, for instance, load switches, disconnecting switches, circuit breakers and the like. In many of these devices, a pair of contacts is arranged within an insulating gas such as $SF_6$ gas or the like, so that during conduction electricity is conducted by maintaining the two contacts in a contact state, while during current interruption the contacts open, an arc discharge occurs thereupon in the gas, and then current is interrupted by extinguishing the arc.

Conventional technology will be explained herein using as an example a puffer-type gas blast circuit breaker widely employed in protection switchgear in high-voltage transmission systems operating at 72 kV or more. FIG. 9 is an example of a schematic cross-sectional diagram of such a gas blast circuit breaker, depicted during the interrupting operation. The various components in FIG. 9 may be assumed to be coaxial cylinders.

As illustrated in FIG. 9, an insulating gas 2 is sealed in a sealed container 1 that comprises a grounded metal, a porcelain tube and the like. Inside the sealed container 1 are arranged a fixed contact section 21 and a movable contact section 22 opposite each other, with a fixed arc contact 7*a* and a movable arc contact 7*b* provided respectively on the fixed contact section 21 and the movable contact section 22. The support structure for these arc contacts inside the sealed container 1 is omitted in the figure.

During normal operation, the arc contacts 7*a* and 7*b* are in a contact conductive state, while during an interrupting operation the contacts 7*a* and 7*b* open by moving relative to each other, whereupon an arc 8 is formed in the space between the two contacts. On the side of the movable contact section 22 there is further arranged a gas flow generating means for blowing the insulating gas 2, as an arc extinguishing gas, onto the arc 8.

As the gas flow generating means there are provided herein a piston 3, a cylinder 4, a puffer chamber 5, and an insulating nozzle 6. On the side of the fixed contact section 21 there is provided a metallic discharge tube 9 through which fixed side hot gas flow 11*a* can pass. On the side of the movable contact section 22 there is provided a hollow rod 12, joined to the movable arc contact 7*b*, through which movable side hot gas flow 11*b* can pass.

In the interrupting process of a gas blast circuit breaker having the above constitution, when the movable contact section 22 operates in the left direction of the figure, the fixed piston 3 compresses the puffer chamber 5, which is the inner space of the piston 4, thereby raising the pressure in that section. The insulating gas 2 in the puffer chamber 5 becomes a high-pressure gas flow that is led to the insulating nozzle 6, and is vigorously blown onto the arc 8 formed between the arc contacts 7*a* and 7*b*. As a result, the electroconductive arc 8 formed between the contacts 7*a* and 7*b* is extinguished and current is shut off.

As is known, the higher the pressure inside the puffer chamber 5, the more strongly the insulating gas 2 is ordinarily blown towards the arc 8, and thus the current interrupting performance that is obtained becomes higher. By being blown onto the high-temperature arc 8, the insulating gas 2 becomes a high-temperature gas that, in the form of the fixed side hot gas flow 11*a* and the movable side hot gas flow 11*b*, flows away from the space between the two arc contacts, dispersing eventually into the interior of the sealed container 1. Although not shown in the figure, sliding portions such as the gap between the piston and the cylinder are often greased in order to reduce friction.

The above is a typical constitution of a puffer-type gas blast circuit breaker that is an example of the gas insulated switchgear. Schemes have been proposed in recent years for achieving a higher current interrupting performance by, in addition to the mechanical compression by the piston 3, actively exploiting the thermal energy of the arc 8.

During the early stages of the interrupting operation, for instance, the movable side hot gas flow 11*b* may be brought into the puffer chamber 5 via holes provided in the hollow rod 12 (Japanese Examined Patent Application Publication No. H07-109744). Alternatively, the puffer chamber 5 may be split in two along the axial direction, so that a high blowing pressure onto the arc 8 may be obtained, in particular during large-current interruption, by limiting the volume of the puffer chamber 5 in the vicinity of the arc 8. Also, a check valve provided at the split section of the puffer chamber 5 prevents a direct high-pressure action of the piston 3, thereby reducing the force with which the movable contact section 22 is driven (Japanese Examined Patent Application Publication No. H07-097466).

$SF_6$ gas, or air, is often used as the insulating gas 2 in the gas insulated switchgear that has become widespread in recent years. $SF_6$ gas has excellent characteristics as regards arc extinction (arc extinguishing performance) and electrical insulation performance, and is widely used, in particular, in a high-voltage gas insulated switchgear. Air is used, in particular, in a small-sized gas insulated switchgear owing to its low cost and its excellent safety and environmental compatibility.

Although $SF_6$ gas is extremely useful in a high-voltage gas insulated switchgear, its use is expected to fall on account of its known significant global warming effect. The magnitude of global warming effect is expressed ordinarily as a global warming potential relative to a global warming potential, i.e. a relative value with respect to a global warming potential of 1 for $CO_2$. As is known, $SF_6$ gas has a global warming potential reaching up to 23900. Moreover, although its safety and environmental compatibility is excellent, air is far poorer than $SF_6$ gas in terms of arc extinguishing performance and electrical insulation performance, and hence its large-scale use in a high-voltage gas insulated switchgear is fraught with difficulties.

In this context, $CO_2$ gas has been proposed as an arc extinguishing gas for the gas insulated switchgear (Uchii, Kawano, Nakamoto and Mizoguchi, "Validation of thermal interrupting performance of $CO_2$ gas as an arc extinguishing medium on the basis of fundamental properties of $CO_2$ gas and a full-scale model circuit breaker" IEEJ Transactions on Power and Energy, vol. 124, 3, pp. 469-475, 2004). The global warming effect of $CO_2$ gas is extremely small relative to that of $SF_6$ gas, of 1/23900, and hence using $CO_2$ gas alone, or a mixed gas with $CO_2$ gas as a main constituent thereof (main constituent being defined herein as the constituent present in the gas at a proportion of 50% or more) should allow significantly restraining the impact of the gas on global warming by replacing $SF_6$ gas in the gas insulated switchgear.

Although the arc extinguishing performance and electric insulation performance of $CO_2$ gas are inferior to those of $SF_6$ gas, the arc extinguishing performance of $CO_2$ is far superior to that of air, while its insulation performance is similar to that of air, or greater. Thus, using $CO_2$ gas by itself, or using a mixed gas having $CO_2$ gas as the main constituent, in lieu of $SF_6$ gas or air, allows providing a gas insulated switchgear having good characteristics overall, and environmentally superior in terms of restraining global warming impact.

When $CO_2$ gas is used in a puffer-type gas insulated switchgear such as the one illustrated in FIG. 9, the scheme proposed in Japanese Examined Patent Application Publication Nos. H07-109744 and H07-097466, of exploiting the thermal energy of the arc 8, is noticeably effective in enhancing the intrinsic effect of $CO_2$ gas (Uchii, Kawano, Nakamoto and Mizoguchi, "Validation of thermal interrupting performance of $CO_2$ gas as an arc extinguishing medium on the basis of fundamental properties of $CO_2$ gas and full-scale model circuit breaker" IEEJ Transactions on Power and Energy, vol. 124, 3, pp. 469-475, 2004).

Apart from $CO_2$ gas, other gases have been proposed, for the same reasons expounded above, as insulating gases for use in the gas insulated switchgear. These gases include, for instance, a perflurocarbon such as $CF_4$ gas or the like, a hydrofluorocarbon such as $CH_2F_2$ gas or the like ("Environmental burden of $SF_6$ and gas insulation mixtures /alternatives to $SF_6$", IEEJ technical communications, 841, 2001), and $CF_3I$ gas (Japanese Patent Application Laid-open No. 2000-164040). These gases have less impact on global warming than $SF_6$ gas, and have relatively high arc extinguishing performance and insulation performance, and hence are effective in reducing the environmental burden of the gas insulated switchgear.

SUMMARY OF THE INVENTION

Thus, using $CO_2$ gas, a perflurocarbon, a hydrofluorocarbon, $CF_3I$ or the like as electrical insulation media and arc extinguishing media in a gas insulated switchgear allows providing a gas insulated switchgear having good performance overall while reducing global warming impact vis-à-vis conventional $SF_6$ gas used in a gas insulated switchgear.

However, all these gases comprise the element C, and hence the gases by themselves, or as main constituents of mixed gases, are problematic in that, when used in the gas insulated switchgear, they dissociate, recombine and generate free carbon as a result of the high-temperature arc generated during current interruption.

When the carbon generated as a result of current interruption adheres onto the surface of a solid insulator such as an insulating spacer or the like, the electrical insulation performance of the solid insulator may become severely impaired, thereby detracting from the quality of the gas insulated switchgear.

Also, when the above-described single gases, or gas mixtures having these gases as main constituents, are used in puffer-type gas blast circuit breakers, and when the thermal energy of the arc is actively used as means for raising the pressure in the puffer chamber so as to enhance current interrupting performance, the temperature of the gas plays a more critical role than in conventional gas blast circuit breakers that rely mainly on mechanical compression by a piston.

When the temperature of the gas becomes high, specifically when the temperature of the gas rises to more than about 3000K, the molecules of the gas tend to dissociate and to form carbon. Therefore, when such gases are used in puffer-type gas blast circuit breakers where the thermal energy of the arc is also actively used for achieving a high puffer chamber pressure, carbon is likely to form as a result, which may impair quality.

An object of the present invention is to provide a gas insulated switchgear having excellent performance and quality, and little global warming impact, by restraining carbon generation as a result of current interruption, also when using as an arc extinguishing medium of the gas insulated switchgear a gas comprising the element C and having a global warming potential lower than that of $SF_6$ gas, for instance $CO_2$ gas, a perflurocarbon, a hydrofluorocarbon, $CF_3I$ or the like.

In order to achieve that object, the present invention is a gas insulated switchgear in which a pair of contacts are arranged in a sealed container filled with an insulating gas having a global warming potential lower than that of $SF_6$ gas, electricity being conducted during conduction by maintaining the two contacts in a contact state, and the two contacts opening during current interruption to extinguish an arc generated between the two contacts by blowing the insulating gas thereon, wherein the insulating gas is a mixed gas comprising at least 50% of a gas comprising the element C, and the mixed gas comprises the element O.

As the mixed gas can be used herein a mixture comprising at least 50% of a gas comprising the element C, and no more than 50% of $O_2$. As the gas comprising the element C can be used a gas comprising the elements C and O, and as the mixed gas can be used a mixed gas comprising at least 50% of this gas comprising the elements C and O, and no more than 25% of $H_2$ gas.

In the gas insulated switchgear according to the present invention having the above constitution, the main constituent of the insulating gas, as the arc extinguishing medium, is the mixed gas having a gas comprising the element C and other gases. The presence of the element O in the mixed gas allows restraining the amount of carbon generated as a result of current interruption.

DESCRIPTION OF THE PREFERRED EMBODIMENTS

(1) First Embodiment

Figure 1:
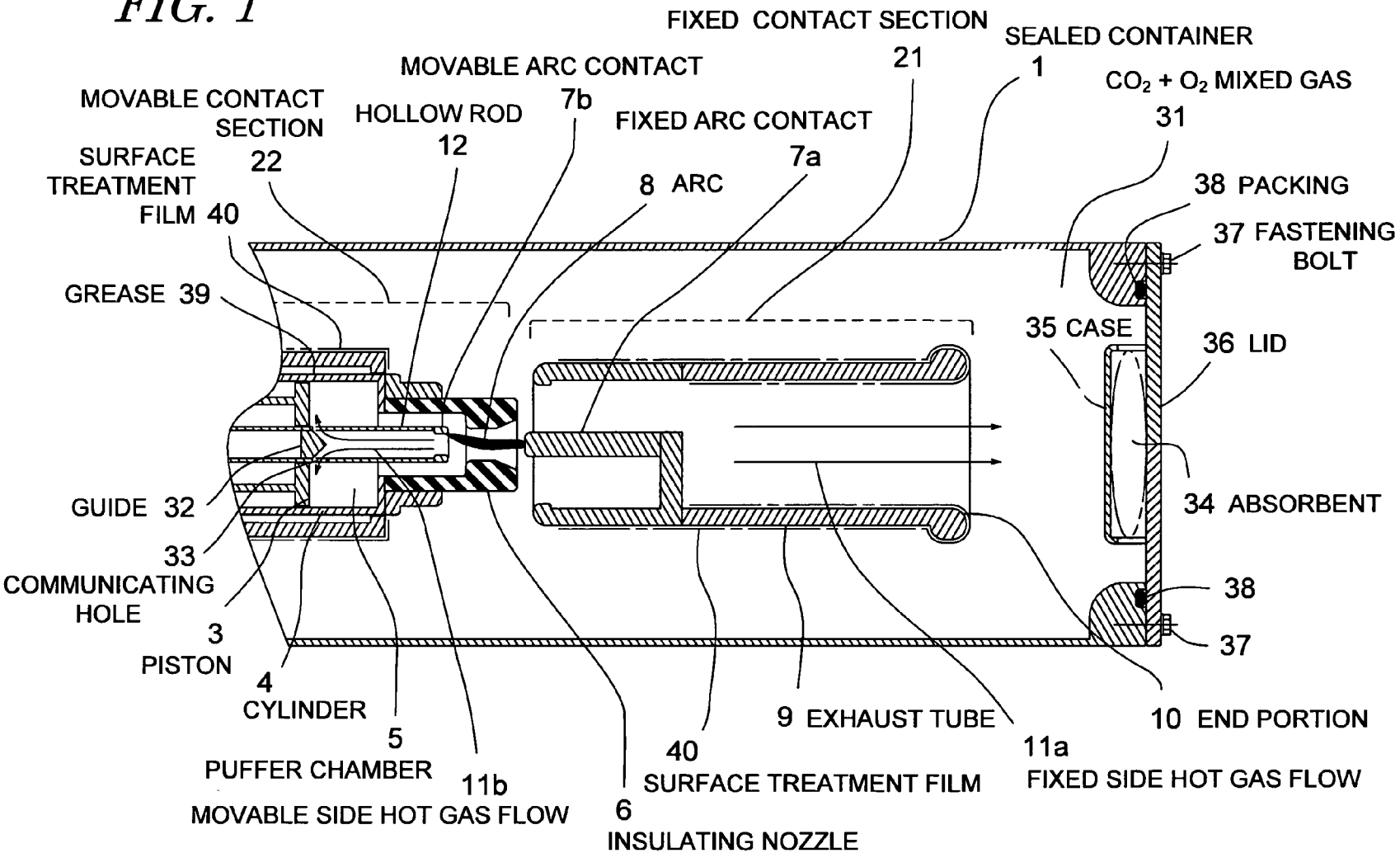
FIG. 1 is a cross-sectional diagram illustrating a first embodiment of the gas insulated switchgear of the present invention.

A first embodiment in accordance with the invention used in a puffer-type gas blast circuit breaker is explained in detail with reference to FIG. 1. In the figure, elements identical to those of the conventional puffer-type gas blast circuit breaker illustrated in FIG. 9 are denoted with the same reference numerals, and their explanation is omitted.

(1-1) Constitution of the First Embodiment

Figure 9:
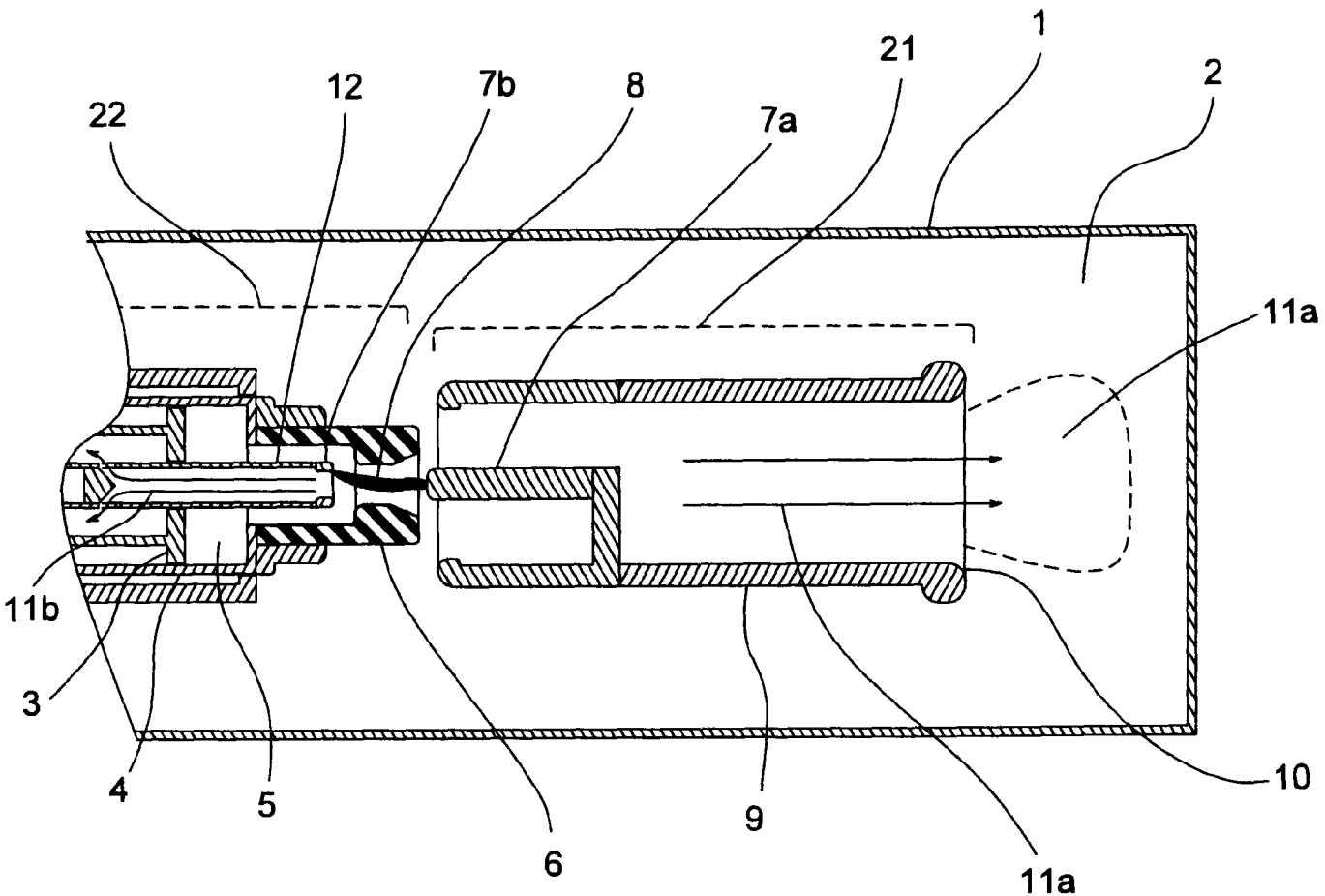
FIG. 9 is a cross-sectional diagram of a puffer-type gas blast circuit breaker being an example of a conventional gas insulated switchgear.

The basic constitution of a gas insulated switchgear in the present embodiment is identical to that of conventional technology illustrated in FIG. 9. That is, a pair of contacts are arranged inside a sealed container 2 filled with an arc extinguishing gas, during current conduction both contacts are kept in contact to enable conduction, while during current interruption the contacts open, an arc discharge occurs in the gas, and current is shut off thereupon by extinguishing the arc.

Pressure rise in the puffer chamber 5 is effected herein not only through mechanical compression by the piston 3, but also by actively bringing the thermal energy of the arc 8 into the puffer chamber 5. Specifically, a guide 32 in FIG. 1 causes the movable side hot gas flow 11*b* flowing inside the hollow rod 12 to pass through a communicating hole 33 and to enter the puffer chamber 5, thereby contributing to raising the pressure in that portion.

The gas used in the present invention as the insulating gas filling the sealed container 1 and functioning as an arc extinguishing gas is a mixed gas comprising at least 50% of a gas comprising the element C and having a global warming potential lower than that of $SF_6$ gas, for instance $CO_2$, a perflurocarbon, a hydrofluorocarbon, $CF_3I$, or the like, and comprising no more than 50% of $O_2$ gas.

These mixed gases include, for instance, a mixed gas of $CO_2$ (70%)+$O_2$ (30%), a mixed gas of $CF_4$ (30%)+$CO_2$ (30%)+$O_2$ (40%), or a mixed gas of $CF_4$ (50%)+$N_2$ (30%)+$O_2$ (20%). In the present embodiment is used a mixed gas 31 of $CO_2$ (70%)+$O_2$ (30%).

An absorbent 34 for absorbing $O_3$, CO and water is arranged inside the sealed container 1. The absorbent 34 is supported inside the sealed container 1 by a case 35.

A check lid 36 is mounted to the sealed container 1 via a bolt 37 in such a way so as to preserve the sealed state inside the sealed container 1. A packing 38 is provided at the joining portion of the lid 36 and the sealed container 1, for preserving the hermeticity of the gas 31 filling the interior. In the packing 38 may be used, for instance, any of nitrile rubber, fluorocarbon rubber, silicone rubber, acrylic rubber, ethylene propylene rubber, ethylene propylene diene rubber, butyl rubber, polyurethane rubber, chlorosulfonated polyethylene rubber and ethylene vinyl acetate.

In order to reduce friction on the sliding surfaces during opening of the fixed arc contact 7*a* and the movable arc contact 7*b* a lubricant grease 39 is applied, specifically, for instance, on the outer peripheral face of the cylinder 4. Silicone grease is used as this grease. A surface treatment 40 such as a phosphoric acid treatment film, an alumina film, a fluorocarbon coating, paint or the like is applied to at least one portion of the metal surface on which no contact conduction takes place, for instance on the outer peripheral faces of the fixed contact section 21 and the movable contact section 22, and on the inner face of an exhaust tube 9.

(1-2) Operation of the First Embodiment

In a gas insulated switchgear having the above constitution, thus, using $CO_2$ gas, a perflurocarbon, a hydrofluorocarbon, $CF_3I$ or the like as main constituents of electrical insulation media and arc extinguishing media in the gas insulated switchgear allows reducing global warming impact vis-à-vis conventional $SF_6$ gas used in a gas insulated switchgear, and allows providing a gas insulated switchgear having good performance overall.

Figure 2:
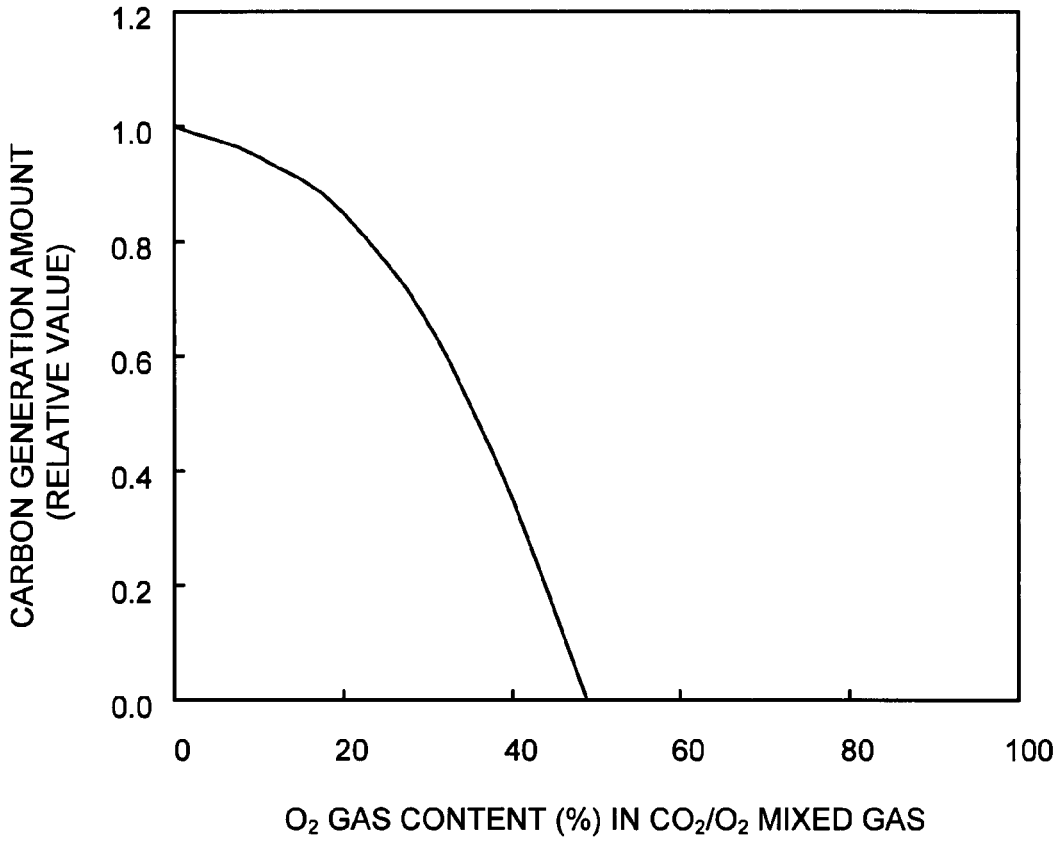
FIG. 2 is a graph illustrating analytical values of the relationship between $O_2$ mixing ratio and amount of generated carbon in a $CO_2/O_2$ mixed gas according to the first embodiment

Although the main constituent of the arc extinguishing medium comprises the element C, the $O_2$ gas mixed therewith allows restraining the amount of carbon generated as a result of current interruption. FIG. 2 illustrates an example of the relationship between the content of $O_2$ gas in a $CO_2/O_2$ mixed gas, and the amount of carbon formed. The figure shows that simply increasing the content of $O_2$ gas allows restraining the amount of carbon generated as a result of current interruption.

That is because the presence of $O_2$ gas facilitates the reaction of C atoms with plentiful O atoms in an arc-induced recombination process, thereby restricting the amount of unbound C. Also, the addition or $O_2$ enhances both arc extinguishing performance and insulation performance, as illustrated in FIGS. 3 and 4.

Figure 3:
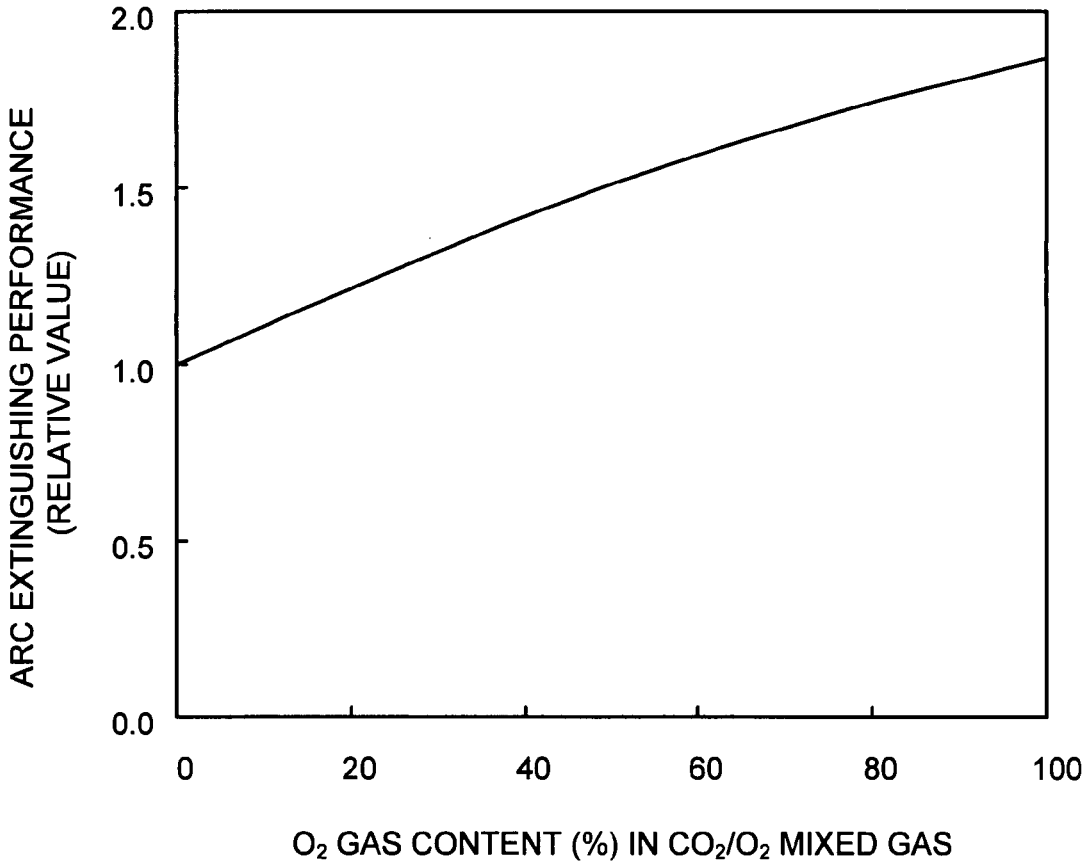
FIG. 3 is a graph illustrating analytical values of the relationship between $O_2$ mixing ratio and arc extinguishing performance in a $CO_2/O_2$ mixed gas according to the first embodiment.
Figure 4:
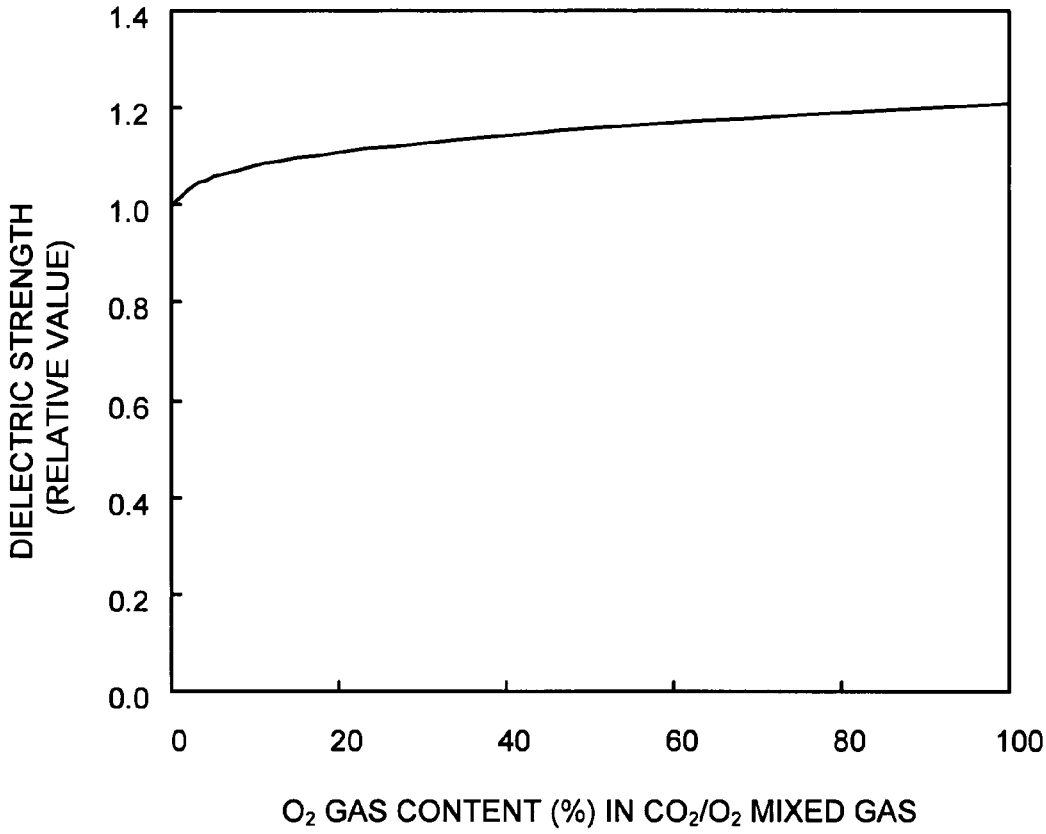
FIG. 4 is a graph illustrating analytical values of the relationship between $O_2$ mixing ratio and dielectric strength in a $CO_2/O_2$ mixed gas according to the first embodiment.

As FIGS. 2, 3 and 4 show, the higher the content of $O_2$ gas, the more the generation of carbon can be restrained, and the more arc extinguishing performance and insulation performance can be enhanced at the same time. However, a greater restraining effect on carbon generation cannot be obtained beyond a content of $O_2$ gas of 50%, as shown in FIG. 2, while increasing the concentration of $O_2$ gas tends to result in problems such as oxidation of the structural elements of the gas insulated switchgear, combustion of insulating materials during arc ignition and the like. Therefore, $O_2$ gas is preferably present in the mixture in a content not exceeding 50%.

Although $CO_2$ gas has been used herein by way of example, the same considerations apply in principle to gases other than $CO_2$, for instance a perflurocarbon, a hydrofluorocarbon, $CF_3I$ and the like.

Thus, using in the arc extinguishing medium a mixed gas having as the main constituent a gas comprising the element C and possessing a global warming potential lower than that of $SF_6$ gas, and no more than 50% of $O_2$ gas, allows providing a good-quality and good-performance gas insulated switchgear in which global warming impact is reduced vis-à-vis conventional gas insulated switchgear using $SF_6$ gas, and in which very little carbon is generated after current interruption.

(1-3) Effect of the First Embodiment

As explained concerning conventional art, using the thermal energy of the arc for raising the pressure in the puffer chamber is effective in enhancing arc extinguishing performance. In the first embodiment, also, the movable side hot gas flow 11*b* flowing through the hollow rod 12 is led into the puffer chamber 5 via the communicating hole 33, contributing thereby to raising the pressure of the puffer chamber 5. Herein, the temperature of the arc extinguishing gas becomes inevitably higher than in a gas blast circuit breaker using mainly mechanical compression. This results in dissociation of the gas molecules, which makes carbon generation more likely. The $O_2$ gas mixed in, however, allows restraining the generation of carbon.

CO and $O_3$ may be generated as a result of igniting an arc with a gas having $O_2$ gas mixed with a gas comprising the element C, such as $CO_2$, a perflurocarbon, a hydrofluorocarbon, $CF_3I$ or the like. CO is a toxic gas, and $O_3$ is also a highly reactive noxious gas. Safety can be increased thus by arranging in the sealed container 1 an absorbent 34 having the function of absorbing these noxious CO and $O_3$ gases.

Also, $O_3$ has a strong denaturating and degrading action on the rubber used in the packing 38, which in turn can impair the quality of the gas insulated switchgear. Degradation of the packing 38 can be prevented, however, by using a material substantially resistant to $O_3$, for instance the above-described rubbers used for packing, i.e. nitrile rubber, fluorocarbon rubber, silicone rubber, acrylic rubber, ethylene propylene rubber, ethylene propylene diene rubber, butyl rubber, polyurethane rubber, chlorosulfonated polyethylene rubber or ethylene vinyl acetate.

The mixed-in $O_2$ gas or the generated $O_3$ gas may promote oxidative degradation of the lubricant grease 39 employed on the sliding surfaces. Using a silicone grease having a strong resistance vis-à-vis theses gases allows herein preserving lubricity.

As is known, traces of water in an environment comprising $CO_2$ gas and $O_2$ gas under high pressure can easily lead to metal corrosion. This concern can be addressed by arranging in the sealed container an absorbent having the function of absorbing water.

Although restricting to no more than 50% the content of $O_2$ gas renders oxidative corrosion or modification of metal surfaces unlikely, subjecting the metal surfaces where no contact conduction takes place to a surface treatment involving for instance a phosphoric acid treatment film, an alumina film, a fluorinated coating, paint or the like allows preventing yet more reliably oxidative corrosion or modification by $O_2$ gas from occurring on the treated portions.

The gas insulated switchgear can be provided as a result having superior performance and quality while having small impact on global warming.

The arc extinguishing gas used in the present embodiment, $CO_2$, a perflurocarbon, a hydrofluorocarbon, $CF_3I$ or the like have been cited as typical gases having a lower global warming potential than $SF_6$ gas while still possessing relatively superior electrical insulation performance and arc extinguishing performance. Other gases may be devised that comprise the element C, that have a lower global warming potential than $SF_6$ gas, and that have also relatively superior performance (compared to air). Using such other gases affords the same effect, as they have the same constitution.

(2) Second Embodiment

Figure 5:
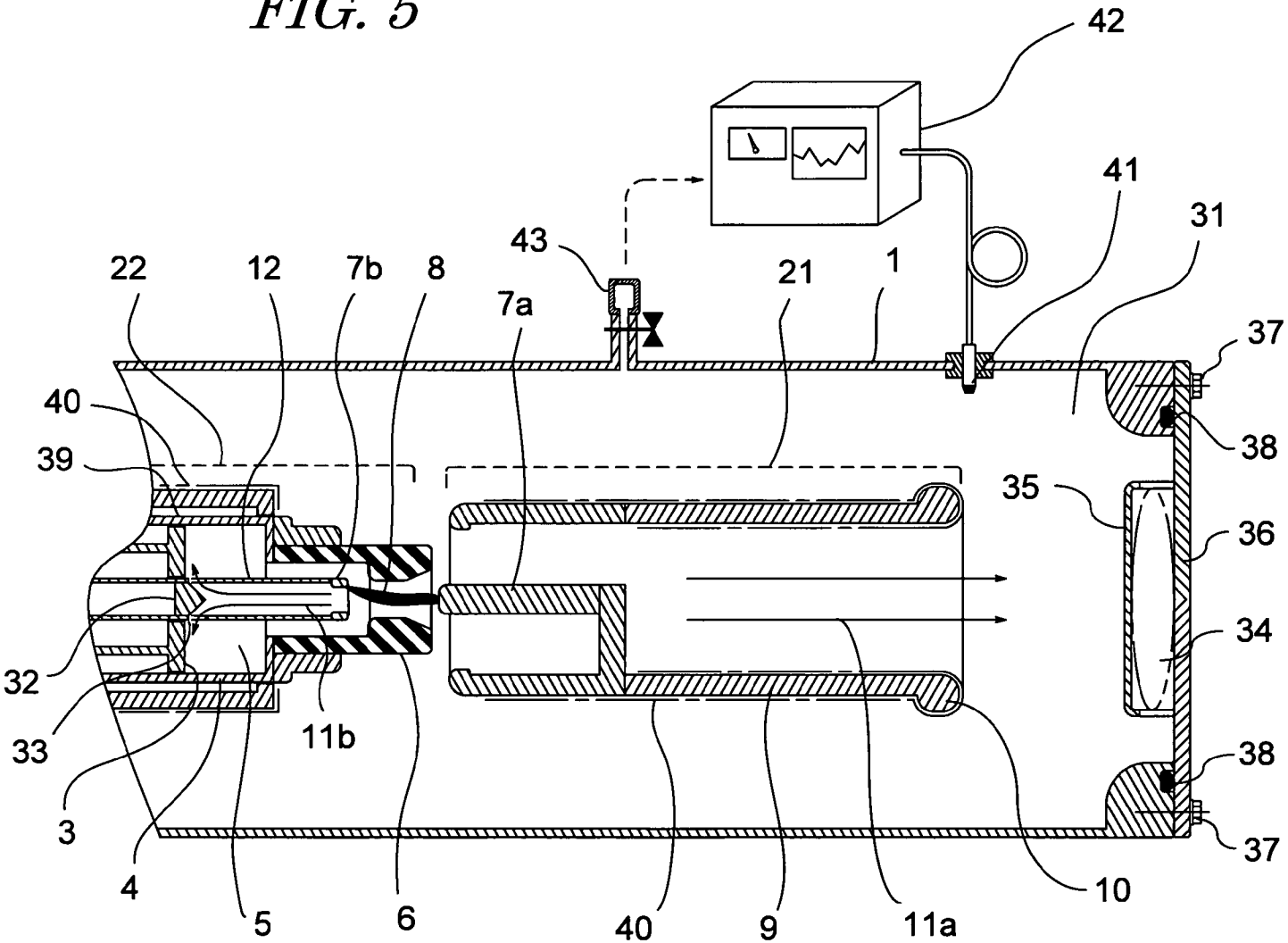
FIG. 5 is a cross-sectional diagram illustrating a second embodiment of the gas insulated switchgear of the present invention.

FIG. 5 illustrates a second embodiment in accordance with the present invention. The basic constitution is identical to that of the example illustrated in FIG. 1, except that herein the sealed container 1 is provided with means for detecting CO gas or $O_3$ gas. Specifically, a sensor 41 capable of detecting CO gas or $O_3$ gas is provided in the sealed container 1, information from the sensor 41 being read by an analyzer 42. Alternatively, small amounts of the gas in the sealed container 1 may also be drawn into a sampling container 43, the sampled gas being then analyzed for the content of CO gas and $O_3$ gas in a separate analyzer.

Every time that current is interrupted in the second embodiment having the above constitution, the filling gas comprising the element C, as well as the $O_2$ gas, decompose and recombine through the action of the arc, so that the concentration of CO gas or $O_3$ generated as a result increases. Even when current is not interrupted, any insulation defects that may be present in the sealed container 1 may give rise to partial discharge, with CO gas or $O_3$ gas forming continuously as a result of such a discharge.

Analyzing and monitoring the presence or concentration of these gases by means of the above-described sensor 41 or sampling container 43 allows knowing the history of the current interruptions that have taken place and/or the occurrence of partial discharge, which is a precursor phenomenon of insulation breakdown. The state of the device can thus be grasped so that accurate check and replacement times can be decided.

(3) Third Embodiment

The basic constitution of the gas insulated switchgear in the third embodiment is identical to that of the first embodiment. In the third embodiment, however, is used a mixed gas comprising at least 50% of a gas such as $CO_2$ or the like, comprising the elements C and O and having a lower global warming potential than $SF_6$ gas, and no more than 25% of $H_2$ gas.

Unlike in the first embodiment, moreover, the thermal energy of the arc is not actively used for raising the pressure inside the puffer chamber, the pressure in the puffer chamber being raised herein mainly through mechanical compression by a piston, and hence the temperature of the arc extinguishing gas does not rise excessively. In concrete terms, the benchmark used herein is a temperature not exceeding 3000K. Specifically, also, the base of the hollow rod 12 is not provided with the communicating hole 33 illustrated in FIG. 1, so that the movable side hot gas flow 11*b* flowing through the hollow rod 12 does not enter the puffer chamber 5.

In the third embodiment, also, an absorbing agent 34 having the function of absorbing water is provided inside the case 35 in the sealed container 1.

Although the arc extinguishing gas in the gas insulated switchgear of the third embodiment having the above constitution does comprise the element C, the constitution of the gas insulated switchgear is such that the temperature of the gas does not rise excessively, and hence carbon generation on account of gas molecule dissociation becomes restrained.

When the thermal energy of the arc is not actively used for raising the pressure in the puffer chamber, with a view of preventing the temperature of the gas from raising excessively, a problem may arise in that the blowing pressure on the arc becomes lower vis-à-vis arc extinguishing chambers of the type in which the thermal energy of the arc is actively used, as in the first embodiment, with arc extinguishing performance diminishing as a result.

In the third embodiment, however, the gas mixture comprises $H_2$ gas, which, thanks to its extraordinary arc extinguishing performance, enhances arc extinguishing performance compensating for the diminished performance derived from not using actively the thermal energy of the arc. $H_2$ gas, which is a gas found in nature and is innocuous to the environment, has less of an environmental impact than a conventional gas insulated switchgear using $SF_6$ gas.

Figure 6:
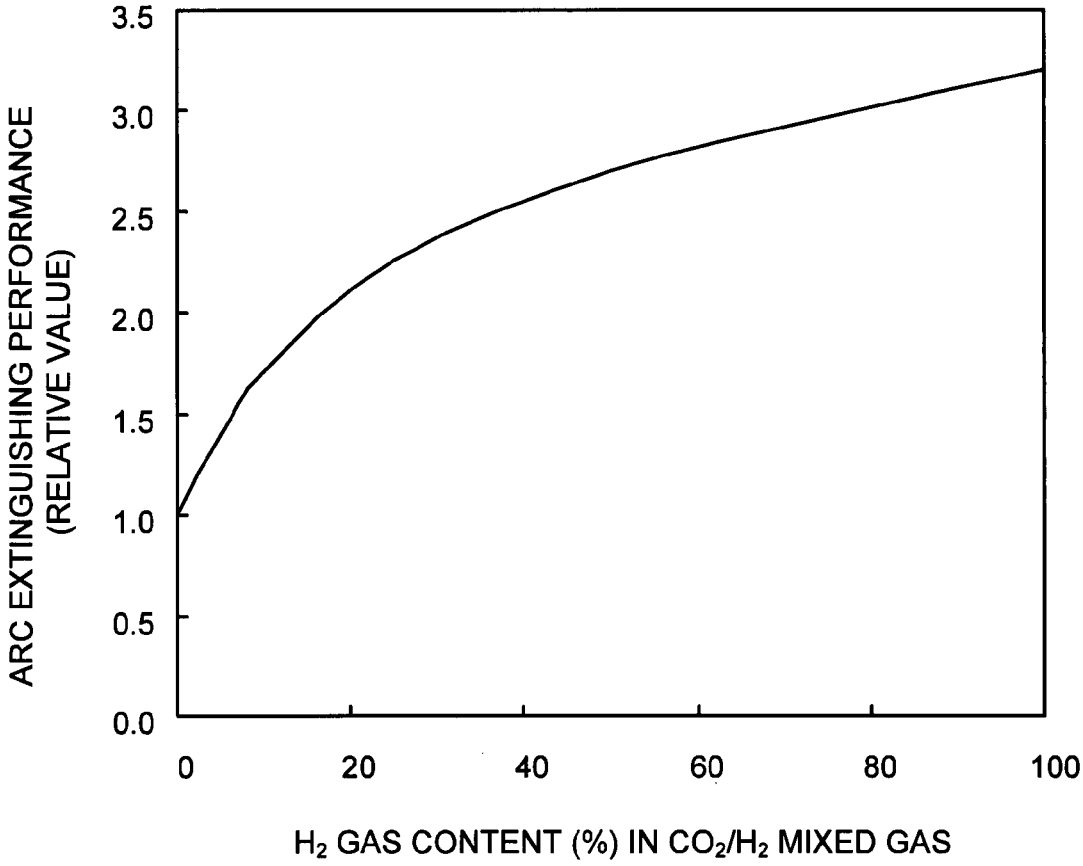
FIG. 6 is a graph illustrating analytical values of the relationship between $H_2$ mixing ratio and arc extinguishing performance in a $CO_2/H_2$ mixed gas according to a third embodiment.

FIG. 6 illustrates an example of the relationship between the content of $H_2$ gas in a $CO_2/H_2$ mixed gas, and arc extinguishing performance. The figure shows that simply increasing the content of $H_2$ gas allows enhancing arc extinguishing performance.

Figure 7:
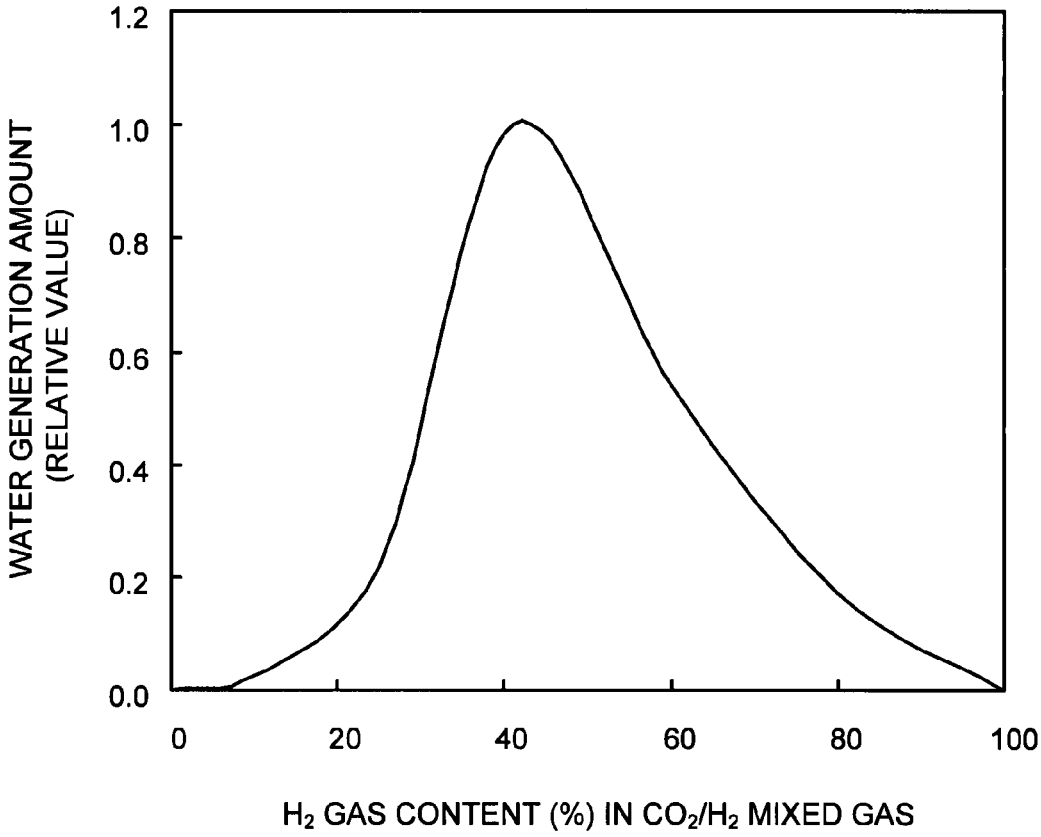
FIG. 7 is a graph illustrating analytical values of the relationship between $H_2$ mixing ratio and amount of generated water in a $CO_2/H_2$ mixed gas according to the third embodiment.

Although arc extinguishing performance can be enhanced by increasing the content of $H_2$ gas, the presence of $H_2$ gas in a gas comprising the element O such as $CO_2$ gas may lead to the formation of water ($H_2O$) during an arc-induced recombination process. The formation of water is associated with deterioration of the metals and insulating materials that make up the gas insulated switchgear. As illustrated in FIG. 7, however, restricting the content of $H_2$ not to exceed 25% allows keeping low the amount of water formed, and hence impairment of device quality can be prevented.

By arranging further the absorbent 34 having the function of absorbing water, any water formed during the current interruption process becomes absorbed, whereby deterioration of equipment quality can be prevented yet more reliably.

As is known, $H_2$ gas boasts an extraordinary arc extinguishing performance, but its electric insulation performance is far inferior to that of air. Thus, although increasing the content of $H_2$ gas may give rise to concerns as regards loss of insulation performance, restricting the content of $H_2$ not to exceed 25% allows minimizing such loss of insulation performance.

Although $CO_2$ gas has been used herein by way of example, the same considerations apply in principle to gases other than $CO_2$, for instance a perflurocarbon, a hydrofluorocarbon, $CF_3I$ and the like. Thus, a gas insulated switchgear can be provided having excellent performance and quality while having small impact on global warming.

(4) Fourth Embodiment

Figure 8:
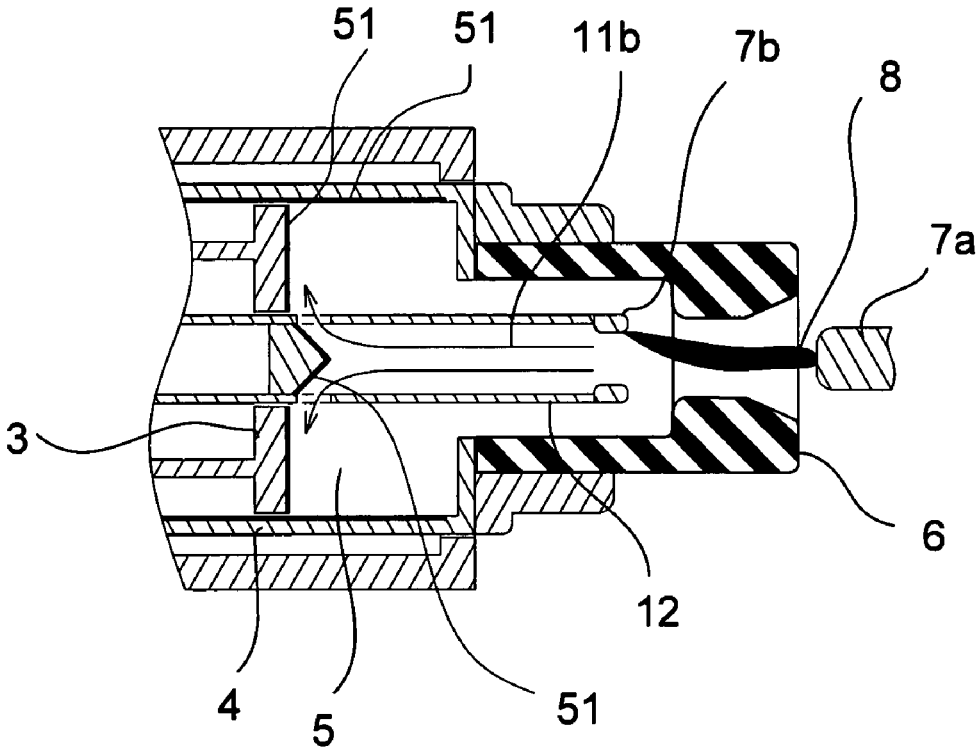
FIG. 8 is an enlarged cross-sectional diagram illustrating a fourth embodiment of the gas insulated switchgear of the present invention.

FIG. 8 illustrates a fourth embodiment in accordance with the invention, in which the movable contact parts are enlarged. In the fourth embodiment, a solid material comprising the element O or H is arranged at a position that is directly exposed to the arc or to the flow of high-temperature gas heated by the arc. Specifically, solid elements 51 comprising the element O or H are respectively arranged in the vicinity of the surface of the guide 32, on the inner periphery of the cylinder 4, an on the side edge face of the puffer chamber 5 of the piston 3.

Upon current interruption, the solid elements 51 comprising the element O or H in the fourth embodiment having such a constitution melt and volatilize through exposure to the high-temperature arc or the high-temperature gas flow. As a result, $O_2$ gas or $H_2$ gas are locally provided at a high concentration in the vicinity of the arc during current interruption only.

In addition to the $O_2$ gas or $H_2$ gas in the insulation gas inside the sealed container 1, this allows providing more $O_2$ gas or $H_2$ gas in the vicinity of the high-temperature arc, which in turn allows enhancing both interrupting performance and prevention of carbon formation.

(5) Other Embodiments

Other embodiments in accordance with the present invention will be apparent to those skilled in the art from consideration of the specification and practice of the invention disclosed herein. The specification and example embodiments should be considered as exemplary only, with a true scope and spirit of the invention being indicated by the following. This application is based upon and claims the benefit of priority from the prior Japanese Patent Application No. JP2006-84813 filed on Mar. 27, 2006; the entire contents of which are incorporated herein by reference.

What is claimed is:

1. A gas insulated switchgear in which a pair of contacts are arranged in a sealed container filled with an insulating gas having a global warming potential lower than that of $SF_6$ gas, electricity being conducted during conduction by maintaining the two contacts in a contact state, and the two contacts opening during current interruption, to extinguish an arc generated between the two contacts by blowing the insulating gas thereon, comprising:

a gas flow generating means for blowing the insulating gas onto the arc generated between the contacts during an opening operation of the contacts, wherein said gas flow generating means comprises a pressure accumulation space, pressure raising means for raising a pressure of the pressure accumulation space, and a gas flow channel that joins the pressure accumulation space and the arc, wherein said pressure raising means comprises a means for raising the pressure of the pressure accumulation space by introducing into the pressure accumulation space thermal energy generated in the arc, wherein said insulating gas is a mixed gas comprising greater than or equal to 20% and less than or equal to 50% of $O_2$ gas and at least 50% of another gas comprising the element C, wherein said gas comprising the element C is any of $CO_2$, a perfluorocarbon, and a hydrofluorocarbon, wherein an absorbent for absorbing water, CO, and $O_3$ is arranged in said sealed container, and wherein said sealed container is provided with a detecting device configured to detect CO gas and $O_3$ gas inside the sealed container.

2. A gas insulated switchgear in which a pair of contacts are arranged in a sealed container filled with an insulating gas having a global warming potential lower than that of $SF_6$ gas, electricity being conducted during conduction by maintaining the two contacts in a contact state, and the two contacts opening during current interruption, to extinguish an arc generated between the two contacts by blowing the insulating gas thereon, comprising:

a gas flow generating means for blowing the insulating gas onto the arc generated between the contacts during an opening operation of the contacts, wherein said gas flow generating means comprises a pressure accumulation space, a pressure raising means for raising a pressure of the pressure accumulation space, and a gas flow channel that joins the pressure accumulation space and the arc, wherein said pressure raising means comprises a puffer piston for compressing said pressure accumulation space, and wherein said insulating gas is a mixed gas comprising at least 50% of a gas comprising the elements C and O, and the mixed gas comprises greater than or equal to 5% and less than or equal to 25% of $H_2$ gas.

3. The gas insulated switchgear according to claim 1, wherein a packing made of material selected from the group consisting of nitrile rubber, fluorocarbon rubber, silicone rubber, acrylic rubber, ethylene propylene rubber, ethylene propylene diene rubber, butyl rubber, polyurethane rubber, chlorosulfonated polyethylene rubber, and ethylene vinyl acetate is used as a sealing means for sealing the insulating gas in said sealed container.

4. The gas insulated switchgear according to claim 1, wherein lubricant silicone grease is applied to surfaces of said two contacts that slide together during the opening operation of the two contacts.

5. The gas insulated switchgear according to claim 1, wherein a surface treatment selected from the group consisting of a phosphoric acid treatment film, an alumina film, a fluorinated coating, and paint is applied to at least one portion of a metal surface on which no contact conduction takes place.

6. The gas insulated switchgear according to claim 1, wherein a solid material comprising the element O or H is arranged at a position exposed to said arc or to a flow of gas heated by the arc.

7. The gas insulated switchgear according to claim 2, wherein an absorbent for absorbing at least one of water, CO, and $O_3$ is arranged in said sealed container.

8. The gas insulated switchgear according to claim 2, wherein a packing made of a material selected from the group consisting of nitrile rubber, fluorocarbon rubber, silicone rubber, acrylic rubber, ethylene propylene rubber, ethylene propylene diene rubber, butyl rubber, polyurethane rubber, chlorosulfonated polyethylene rubber, and ethylene vinyl acetate is used as a sealing means for sealing the insulated gas in said sealed container.

9. The gas insulated switchgear according to claim 2, wherein lubricant silicone grease is applied to surfaces of said two contacts that slide together during the opening operation of the two contacts.

10. The gas insulated switchgear according to claim 2, wherein a surface treatment selected from the group consisting of a phosphoric acid treatment film, an alumina film, a fluorinated coating, and paint is applied to at least one portion of a metal surface on which no contact conduction takes place.

11. The gas insulated switchgear according to claim 2, wherein said sealed container is provided with a detecting device configured to detect CO or $O_3$ gas inside the sealed container.

12. The gas insulating switchgear according to claim 2, wherein a solid material comprising the element O or H is arranged at a position exposed to said arc or to a flow of gas heated by the arc.

13. A gas insulated switchgear in which a pair of contacts are arranged in a sealed container filled with an insulating gas having a global warming potential lower than that of $SF_6$ gas, electricity being conducted during conduction by maintaining the two contacts in a contact state, and the two contacts opening during current interruption, to extinguish an arc generated between the two contacts by blowing the insulating gas thereon, comprising:

a gas flow generating device configured to blow the insulating gas onto the arc generated between the contacts during an opening operation of the contacts, wherein said gas flow generating device comprises a pressure accumulation space, a pressure raising device configured to raise a pressure of the pressure accumulation space, and a gas flow channel that joins the pressure accumulation space and the arc, wherein said pressure raising device comprises a device configured to raise the pressure of the pressure accumulation space by introducing into the pressure accumulation space thermal energy generated in the arc, wherein said insulating gas is a mixed gas comprising greater than or equal to 20% and less than or equal to 50% of $O_2$ gas and at least 50% of another gas comprising the element C, wherein said gas comprising the element C is any of $CO_2$, a perfluorocarbon, and a hydrofluorocarbon, wherein an absorbent for absorbing water, CO, and $O_3$ is arranged in said sealed container, and wherein said sealed container is provided with a detecting device configured to detect CO gas and $O_3$ gas inside the sealed container.

* * * * *